US009538620B2

(12) United States Patent
Kim

(10) Patent No.: US 9,538,620 B2
(45) Date of Patent: Jan. 3, 2017

(54) LIGHTING APPARATUS HAVING COMMUNICATION MODULE

(71) Applicant: LG INNOTEK CO., LTD., Seoul (KR)

(72) Inventor: Dae Hun Kim, Seoul (KR)

(73) Assignee: LG INNOTEK, CO., LTD., Seoul (KR)

( * ) Notice: Subject to any disclaimer, the term of this patent is extended or adjusted under 35 U.S.C. 154(b) by 0 days.

(21) Appl. No.: 14/441,732

(22) PCT Filed: Nov. 8, 2013

(86) PCT No.: PCT/KR2013/010151

§ 371 (c)(1),
(2) Date: May 8, 2015

(87) PCT Pub. No.: WO2014/073913

PCT Pub. Date: May 15, 2014

(65) Prior Publication Data

US 2015/0289349 A1 Oct. 8, 2015

(30) Foreign Application Priority Data

Nov. 8, 2012 (KR) ..... 10-2012-0126060

(51) Int. Cl.
*F21Y 105/10* (2016.01)
*F21Y 105/00* (2016.01)
(Continued)

(52) U.S. Cl.
CPC ..... *H05B 37/0272* (2013.01); *F21K 9/1375* (2013.01); *F21V 23/006* (2013.01);
(Continued)

(58) Field of Classification Search
CPC .... F21K 9/1375; F21V 23/006; F21V 23/007; F21V 23/009; F21V 23/0435; F21V 29/70; F21V 29/78; H05B 33/0842; H05B 37/0272; F21Y 2101/02; F21Y 2105/001
(Continued)

(56) References Cited

U.S. PATENT DOCUMENTS

2005/0141221 A1* 6/2005 Yu ..... H05B 37/0272 362/253
2008/0068841 A1 3/2008 Chi et al.
(Continued)

FOREIGN PATENT DOCUMENTS

JP 2008-204922 A 9/2008
JP 2010040495 A 2/2010
(Continued)

OTHER PUBLICATIONS

Eazzydv BC-680 Bulb CCTV Security DVR Camera (without cover) Item No. 1710172 Aug. 24, 2012 http://www.eazzydv.com/c576.html.*
(Continued)

*Primary Examiner* — Alexander H Taningco
*Assistant Examiner* — Renan Luque
(74) *Attorney, Agent, or Firm* — Saliwanchik, Lloyd & Eisenschenk

(57) ABSTRACT

Disclosed is a lighting apparatus. The lighting apparatus includes a lighting module to receive therein a lighting part that emits light to an outside and a power control part having a connector; and a communication module extending by passing through the lighting module and detachably coupled to the connector to transfer a control signal received through a wireless network to the power control part.

8 Claims, 11 Drawing Sheets

(51) Int. Cl.

| | |
|---|---|
| ***F21V 29/78*** | (2015.01) |
| ***F21V 29/70*** | (2015.01) |
| ***H05B 33/08*** | (2006.01) |
| ***H05B 37/02*** | (2006.01) |
| ***F21K 99/00*** | (2016.01) |
| ***F21V 23/00*** | (2015.01) |
| ***F21V 23/04*** | (2006.01) |
| *F21Y 101/02* | (2006.01) |

(52) U.S. Cl.
CPC ..... *F21V 23/007* (2013.01); *F21V 23/009* (2013.01); *F21V 23/0435* (2013.01); *H05B 33/0842* (2013.01); *F21V 29/70* (2015.01); *F21V 29/78* (2015.01); *F21Y 2101/02* (2013.01); *F21Y 2105/001* (2013.01)

(58) Field of Classification Search
USPC ..... 315/297, 201, 113, 153, 294, 151, 152,315/291, 186, 210, 86, 292, 307, 34, 121, 131,315/154, 185 R, 209 R, 250, 254, 287, 302, 360,315/76; 362/231, 103, 106, 183, 235, 249.06, 362/294
See application file for complete search history.

(56) References Cited

U.S. PATENT DOCUMENTS

2008/0304249 A1* 12/2008 Davey ..... F21V 23/0442 362/20
2010/0118148 A1* 5/2010 Lee ..... F21K 9/17 348/164
2011/0109215 A1* 5/2011 Choi ..... F21V 19/0035 313/45
2012/0026726 A1* 2/2012 Recker ..... F21K 9/13 362/157
2012/0215325 A1 8/2012 Wu
2013/0223061 A1* 8/2013 Hwu ..... F21K 9/135 362/235

FOREIGN PATENT DOCUMENTS

JP 2011204637 * 10/2011 ..... F21S 2/00
JP 2011-228130 A 11/2011
KR 10-2009-0127571 A 12/2009
KR 10-2012-0061428 A 6/2012
WO WO-2007108019 A1 9/2007

OTHER PUBLICATIONS

Translation—JP 2011204637 Setomoto Oct. 2011.*
International Search Report in International Application No. PCT/KR2013/010151, filed Nov. 8, 2013.
European Search Report dated Apr. 13, 2016 in European Application No. 13853754.3.

* cited by examiner (a)

(b)

(a)

(b)

(a)

(b)

LIGHTING APPARATUS HAVING COMMUNICATION MODULE

CROSS-REFERENCE TO RELATED APPLICATIONS

This application is the U.S. national stage application of International Patent Application No. PCT/KR2013/010151, filed Nov. 8, 2013, which claims priority to Korean Application No. 10-2012-0126060, filed Nov. 8, 2012, the disclosures of each of which are incorporated herein by reference in their entirety.

TECHNICAL FIELD

The embodiment relates to a lighting apparatus having a communication module.

BACKGROUND ART

A light emitting diode (LED) is a semiconductor device that converts electricity into ultraviolet rays, infrared rays, or visible light using characteristics of a compound semiconductor. The LEDs have been used for home appliances, remote controllers, large-scale screen boards, etc.

In general, users manually manipulate a switch connected to a lighting apparatus through a cable in order to turn on or off the lighting apparatus. In this case, the patient, the senior citizen or the infirm who cannot move freely, or children who cannot reach the switch may feel inconvenience when turning on or off the lighting apparatus.

Recently, in order to solve the inconvenience, a lighting apparatus, which is turned on or turn off and can adjust lighting intensity by using a remote controller, has been launched in the market.

As the lighting and communication markets have been diversified, the requirement for the selective control of the characteristics (color temperature, dimming value, or brightness) of the lighting apparatus, or the selection of a communication scheme based on the speed/distance/power consumption among various communication schemes such as ZigBee, WiFi, or Bluetooth is increased.

In addition, since the communication module of receiving, processing and transmitting a user command is integrated with the light apparatus, when a power supply unit, an LED, a general lighting device and/or a control unit in the lighting apparatus are/is out of order, the lighting apparatus including the communication module must be exchanged.

An LED light source having high brightness has been used for lighting lamps. In addition, the LED light source has high energy efficiency and long life cycle so that the replacement cost is low. Further, the LED light source has superior durability against vibration or shock, and does not use a hazardous substance such as mercury, so the incandescent lamps or fluorescent lamps have been replaced with LED light sources for energy-saving, environmental protection and cost reduction.

Further, LEDs are useful for light sources of middle or large sized LCD televisions and monitors. The LEDs have superior color purity and low power consumption and can be easily miniaturized as compared with cold cathode fluorescent lamps (CCFLs) mainly used for light sources of the liquid crystal displays (LCDs). Thus, the products employing the LEDs are mass-produced, and also, researches on the LEDs are more actively conducted.

Recently, various technologies, which use a blue LED and reproduce white light using a quantum dot (QD) emitting red light and green light as a phosphor, are being developed because the white light reproduced by using the quantum dot has high brightness and superior color reproductivity.

Nevertheless, the need of researches for reducing light loss, which may occur in case where the LED is applied to LED backlight units, and improving color uniformity still arises.

DISCLOSURE OF INVENTION

Technical Problem

The embodiment provides a communication module detachably installed in a lighting apparatus.

Solution to Problem

According to the embodiment, there is provided a lighting apparatus including a lighting module to receive therein a lighting part that emits light to an outside and a power control part having a connector; and a communication module extending by passing through the lighting module and detachably coupled to the connector to transfer a control signal received through a wireless network to the power control part.

Advantageous Effects of Invention

According to the embodiment, since the wireless communication module is detachably formed in the lighting module, when the lighting part of the lighting module is exchanged, the communication module can be preserved by detaching the communication module from the lighting module, so that the cost may be reduced.

According to the embodiment, the communication module is formed in a dongle type to allow the communication module to be inserted through the outer surface of the lighting module, so that the detachable-type communication module may be easily fastened.

According to the embodiment, since various wireless communication schemes (such as Zigbee, WiFi and Bluetooth) are selectively implemented in the wireless communication part of the communication module, an optimal wireless communication scheme may be selected by taking into consideration a speed, a distance and a power consumption, so that the data reception, transmission and control may be effectively performed.

BRIEF DESCRIPTION OF DRAWINGS

FIG. 1 is a block diagram showing a lighting system according to the embodiment.

MODE FOR THE INVENTION

Figure 1:
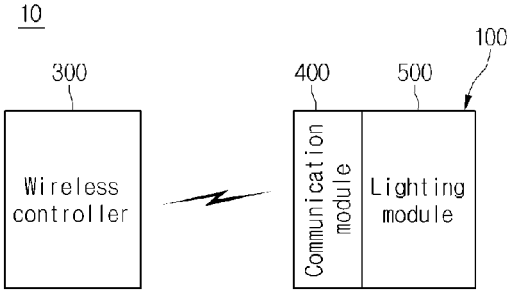
FIG. 1 is an exploded perspective view showing an LCD according to an embodiment.

Hereinafter, embodiments will be described in detail with reference to accompanying drawings so that those skilled in the art can easily work with the embodiments. However, the embodiments may have various modifications. The thickness and size of each layer shown in the drawings may be exaggerated, omitted or schematically drawn for the purpose of convenience or clarity. In addition, the size of elements does not utterly reflect an actual size. The same reference numbers will be assigned the same elements throughout the drawings.

In the following description, when a predetermined part "includes" a predetermined component, the predetermined part does not exclude other components, but may further include other components if there is a specific opposite description.

The thickness of each layer shown in the drawings may be enlarged for the purpose of convenience or clarity. In addition, the size of elements does not utterly reflect an actual size. The same reference numbers will be assigned the same elements throughout the drawings. In the description of the embodiments, it will be understood that, when a layer, a film, a region or a plate is referred to as being "on" or "under" another layer, another film, another region, or another plate, it can be "directly" or "indirectly" on the other layer, film, region, plate, or one or more intervening layers may also be present. Such a position of the layer has been described with reference to the drawings.

The embodiment provides a lighting system including a communication module detachably installed in a lighting module.

Hereinafter, a lighting system will be described with reference to FIGS. 1 to 4.

Figure 2:
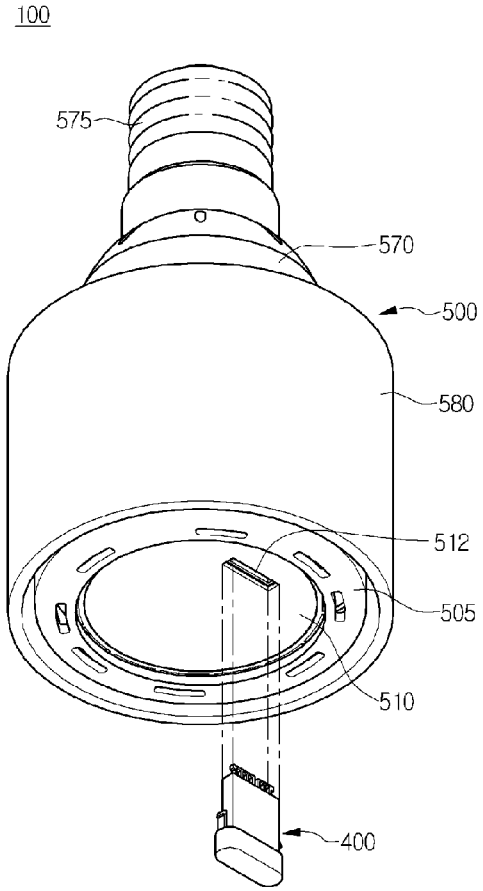
FIG. 2 is a perspective view showing the lighting apparatus of FIG. 1 according the first embodiment.
Figure 3:
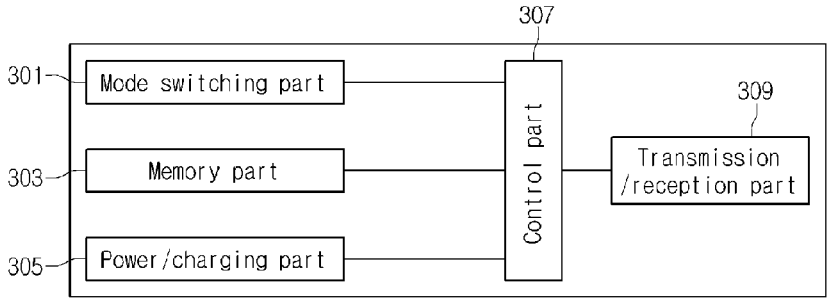
FIG. 3 is a block diagram showing the wireless controller of FIG. 1.
Figure 4:
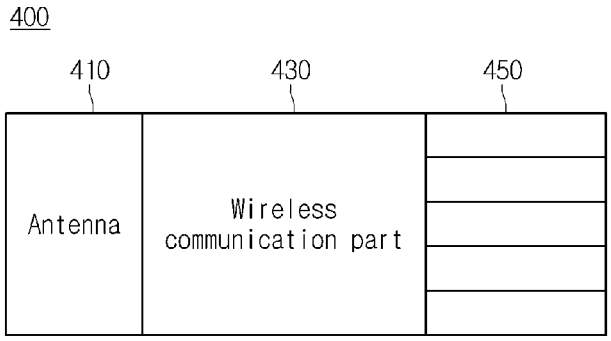
FIG. 4 is a block diagram showing the communication module of FIG. 1.

FIG. 1 is a view showing a configuration of a lighting system according to the embodiment. FIG. 2 is a perspective view showing the lighting apparatus of FIG. 1. FIG. 3 is a block diagram showing a configuration of the wireless controller of FIG. 1. FIG. 4 is a block diagram showing a configuration of a communication module of FIG. 1.

Referring to FIG. 1, the lighting system according to the embodiment includes a wireless controller 300 and a lighting apparatus 100.

The wireless controller 300 is an input unit to input a user command, and transmits a control signal according to the user command to a communication module 400 through a wireless network.

The wireless controller 300 may include a remote controller or a smart phone.

The wireless network between the wireless controller 300 and the communication module 400 may be determined depending on wireless environments.

A network, such as WiFi, ZigBee, Z-wave or Bluetooth, may be applied for a wireless light control.

The wireless controller 300 may have the configuration shown in FIG. 3.

Referring to FIG. 3, the wireless controller 300 includes a mode switching part 301, a memory part 303, a power/charging part 305, a control part 307 and a transmission/reception part 309.

The mode switching part 301 performs the switching of an operating mode. For example, the mode switching part 301 may perform the switching to the electronic appliance control while performing the typical function of the remote controller.

The memory part 303 may store operation and communication control programs/protocols.

The power/charging part 305 charges power to the wireless controller 30 and supplies power for operating the wireless controller 300.

The transmission/reception part 309 transmits the user command, which is provided from the control part 307, to the communication module 400 of the lighting apparatus 100 through a preset wireless network.

The control part 307 controls the operations of the mode switching part 301, the power/charging part 305 and the transmission/reception part 309 by using the data stored in the memory part 303.

The lighting apparatus 100 may be configured as shown in FIG. 2.

The lighting apparatus 100 includes a lighting module 500 including a lighting part and the communication module 400 to transmit a control signal through the communication with the wireless controller 300.

The communication module 400 constituting the lighting apparatus 100 has a detachable-type structure in which the communication module 400 is fixedly inserted into an inserting groove 511 of the lighting module 500 to transmit a control signal as shown in FIG. 2.

The lighting apparatus 100 includes the inserting groove 511 into which a plurality of pins of an interface part 450 of the communication module 400 are inserted.

As shown in FIG. 2, the inserting groove 511 may protrude, and may be connected with a control part 520 including a power supply part of the lighting module 500.

The communication module 400 of the lighting apparatus 100 is detachably installed in the lighting module 500, so that the communication module 400 may be reused when the power supply part of a lighting part 530 or the control part 520 constituting the lighting module 500 is replaced with new one.

The communication module 400 has the configuration shown in FIG. 4.

The communication module 400 is prepared as a single housing. The housing may be provided therein with an antenna part 410, a wireless communication part 430 and an interface part 450 which are formed in one unit.

The antenna part 410 receives the control signal transmitted from the wireless controller 300 through the wireless network.

The wireless communication part 430 receives the control signal from the antenna part 410, and generates a plurality of output signals to be transmitted to the gateway module 500 according to the control signal.

The wireless communication module 430 includes a communication integrated circuit 435 to analyze the control signal of the antenna part 410 according to the types of the wireless network.

In other words, the communication module 400 selects the communication integrated circuit according to the predetermined wireless network environment to install the communication integrated circuit therein.

The communication integrated circuit 435 may support at least one of ZigBee, Z-wave, WiFi, and Bluetooth communication schemes.

The interface part 450 includes the plurality of pins corresponding to a plurality of output signals output from the wireless communication part 430.

As shown in FIG. 4, five pins may be provided, but the embodiment is not limited thereto.

Meanwhile, the lighting module 500 includes an inner case 570 having a connecting terminal 575 at an upper portion of the inner case 570 and an inserting part at a low portion of the inner case 570, a heat sink (not shown) into which the inserting part of the inner case 570 is inserted, a light emitting module part including a plurality of light emitting devices which emit the light to the bottom surface of the heat sink, a guide member 505 coupled to a lower peripheral region of the heat sink to allow the light emitting module part to be firmly fixed to the heat sink, a lens 510 formed between the guide member 505 and the light emitting module part, and an outer case 580 outside the heat sink.

The lens 510 includes a lens opening part 512 through which the communication module 400 is inserted. The communication module 400 is connected to the connector of the power control part through the lens opening part 512, such that the output signal by the control signal is transferred to the lighting module 500 through the wireless network.

The interface between the communication module 400 and the lighting module 500 may set the output signals of the pins according to a light control scheme.

Hereinafter, the configuration of the detachable-type communication module 400 fixedly inserted into the lighting module 500 will be described with reference to FIGS. 5 to 7.

Figure 5:
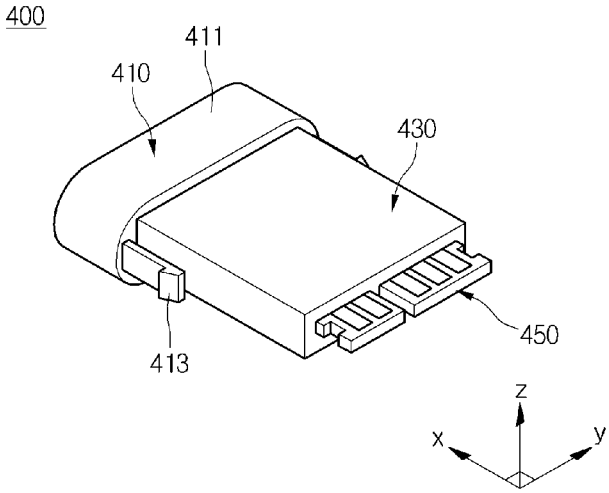
FIG. 5 is a perspective diagram showing the communication module of FIG. 1.

FIG. 5 is a perspective view showing the communication module of FIG. 1. FIG. 6 is top and side views showing the communication module of FIG. 5. FIG. 7 is a top view showing a printed circuit board inside the communication module of FIG. 5.

Figure 6:
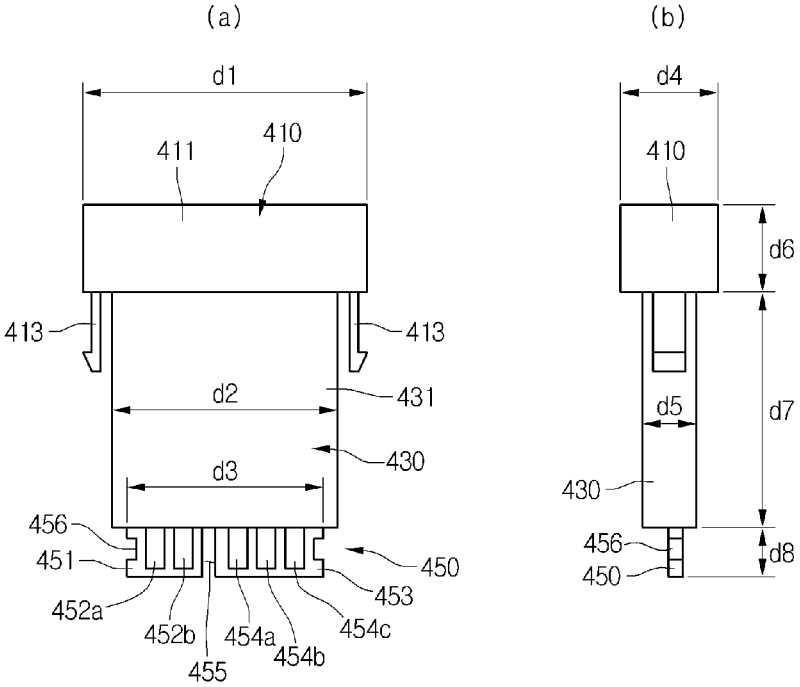
FIG. 6 is top and side views showing the communication module of FIG. 5.
Figure 7:
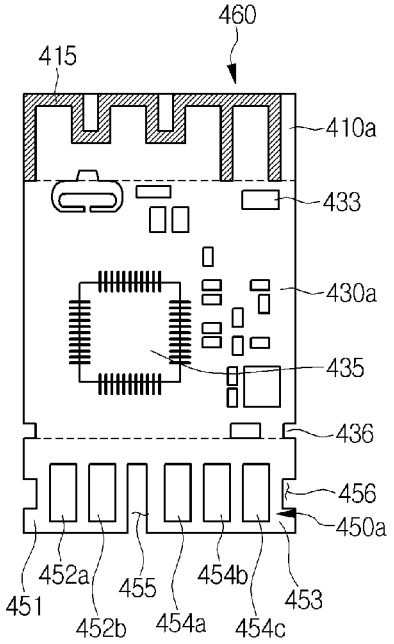
FIG. 7 is a top view showing the printed circuit board in the communication module of FIG. 6.

Referring to FIGS. 5 to 7, the communication module 400 according to the embodiment includes a printed circuit board into which the antenna part 410, the wireless communication part 430 and the interface part 450 are integrated, and housings 411 and 431 to receive a portion of the printed circuit board.

As shown in FIG. 6, in the housings 411 and 431, a region corresponding to the interface part 450 protrudes outward to receive the printed circuit board.

The housings 411 and 431 include a first receiving part 411 to receive the antenna part 410, and a second receiving part 431 protruding from the first receiving part 411 in the first direction (x axis) and to receive the wireless communication part 430.

The first and second receiving parts 411 and 431 may be provided in one body. The first and second receiving parts 411 and 431 may be an assembly in which the upper body and the lower body are coupled with each other in a second direction (z axis) perpendicular to the first direction (x axis).

The housings 411 and 431 may include an insulating material. Preferably, the housings 411 and 431 may include rigid plastic, such as polyimide.

The first receiving part 411 is provided therein with a space to receive the antenna part 410 of the printed circuit board, and has a rectangular shape having a long length in the third direction (y axis).

The first receiving part 411 may have a first width d1 of 20 mm to 25 mm, preferably, the first width d1 of 22 mm in the third direction (y axis), and may have a width d6 of 6 mm to 7 mm, preferably, the width d6 of 6.4 mm to 6.5 mm in the first direction (x axis). In addition, the first receiving part 411 has the height d4 of 7 mm to 8 mm, preferably, the length d4 of 7.7 mm in the second direction (z axis).

The side of the first receiving part 411 may be chamfered in such a manner that the side has a predetermined curvature.

The printed circuit board inserted into the space of the first receiving part 411 includes an antenna region corresponding to the antenna part 410.

An antenna region 410*a* is formed at one end of the printed circuit board as shown in FIG. 7, and includes an antenna pattern 415 formed on the support substrate 432 through the patterning process.

The antenna pattern 415 may have a planar inverted F antenna (PIFA), but the embodiment is not limited thereto.

In other words, the antenna pattern 415 may be realized in the shape of a monopole antenna, or the shape of a dipole antenna.

The antenna region 410*a* may include the support substrate 432 serving as a dielectric body of the antenna, the antenna pattern 415 formed on the support substrate 432, a ground layer (not shown) under the substrate 432, and a matching pattern (not shown) formed inside or outside the dielectric body 432.

The antenna part 410 is provided to transmit/receive a signal having a preset frequency band. In other words, the antenna pattern 415 makes resonance at the frequency band to allow a signal to pass therethrough. The antenna pattern 415 makes resonance at the predetermined reference impedance.

The antenna pattern 415 is provided adjacent to the ground layer, and has one end serving as a feeding point. In this case, the feeding point may extend to the bottom surface of the support substrate 432 through the support substrate 432 serving as the dielectric body. In addition, the antenna pattern 415 may include at least one horizontal component circuit and at least one vertical component circuit distinguished from each other by at least one bending part.

For example, the antenna pattern 415 may be prepared in the form of a transmission circuit corresponding to at least one of a meander type, a spiral type, a step type, and a loop type.

A ground layer is provided to ground an antenna pattern 415.

The internal or external matching pattern is provided in order to match the impedance of the antenna pattern 415 with reference impedance.

As described, the antenna part 410 is provided in the form of a plate, so that the antenna part 410 may be integrated in the small-size communication module 400.

The antenna pattern 415 may include a conductive material or a material containing metal such as copper (Cu), aluminum (Al), nickel (Ni), or molybdenum (Mo).

Meanwhile, the second receiving part 431 protruding in the first direction (x axis) from the first receiving part 411 may have a width d2 of 17 mm to 18 mm, preferably, the width d2 of 17.4 mm to 17.5 mm in the third direction (y axis). In addition, the second receiving part 431 may have a width d7 of 18 mm to 19 mm, preferably, the width d7 of 18 mm to 18.2 mm in the first direction (x axis). In addition, the height d5 of the second receiving part 431 in the second direction (z axis) may be in the range of 4.5 mm to 5.2 mm, preferably, 5 mm.

Since the second receiving part 431 has the width d2 narrower than the width of the first receiving part 411 in the third direction (y axis) as described above, a predetermined dummy space is formed at the lateral side of the first receiving part 411. In addition, since the second receiving part 431 has a height d5 lower than that of the first receiving part 411, the second receiving part 431 may be formed with a step difference from the first receiving part 411.

The second receiving part 431 has the shape of a cylinder having a space to receive the wireless communication part 430 of the printed circuit board therein. The second receiving part 431 may have a rectangular shape as shown in FIG. 5.

A fixing part 413 is formed in the space formed at the lateral side of the first receiving part 411.

As shown in FIG. 6, the fixing part 413 is formed in the dummy space resulting from the difference in an area between the first and second receiving parts 411 and 431, and protrudes in the first direction (x axis) from the lateral side of the first receiving part 411.

Since the fixing part 413 is integrally formed with a body of the housing 411 or 431 and provided at one end thereof with a triangular protrusion, the fixing part 413 is locked with the lighting module 500 when being inserted into the lighting module 500, so that the fixing strength may be improved.

Fixing parts 413 may be formed at both lateral sides of the second receiving part 431, and the triangular protrusions of the fixing parts 413 may be provided in opposition to each other so that the triangular protrusions are directed outward.

Meanwhile, as shown in FIG. 7, a plurality of devices are mounted in a module region 430*a* of the printed circuit board corresponding to the wireless communication part 430 inserted into the second receiving part 431.

The module region 430*a* has a wireless integrated circuit 435 installed therein in order to make communication with the wireless control module 300, and the wireless integrated circuit 435 may selectively employ one of ZigBee, WiFi, Z-wave, and Bluetooth wireless integrated circuits according to the wireless environment. In this case, the passive devices and the circuit configurations of a peripheral part of the wireless integrated circuit 435 may be varied according to the types of the wireless integrated circuit 435.

A connection pattern 433 may be formed at the boundary region between the module region 430*a* and the antenna region 410*a* for the purpose of connection with an external antenna.

A recess part 436 is formed at the boundary region between the module region 430*a* and a terminal region 450*a* to fix the housing 411 or 431 to the printed circuit board. The recess part 436 is coupled with the protrusion formed on the inner surface of the housing 411 or 431.

The terminal region 450*a* of the printed circuit board corresponding to the interface part 450 protruding from the end portion of the second receiving part 431 of the housings 411 and 431 includes the pins 452*a*, 452*b*, 454*a*, 454*b* and 454*c* as shown in FIG. 6.

The terminal region 450*a* may have the length d8 of 3.5 mm to 4.0 mm in the first direction (x axis) from the end portion of the housing 411 or 431, and may have the width d3 of 15 mm in the third direction (y axis).

The terminal region 450*a* includes the pins 452*a*, 452*b*, 454*a*, 454*b* and 454*c* on the support substrate 432, and the pins 452*a*, 452*b*, 454*a*, 454*b* and 454*c* may include five pins 452*a*, 452*b*, 454*a*, 454*b* and 454*c*, but the embodiment is not limited thereto.

If the five pins 452*a*, 452*b*, 454*a*, 454*b*, and 454*c* are provided as described above, the five pins 452*a*, 452*b*, 454*a*, 454*b*, and 454*c* are grouped into several groups, and the terminal region 450*a* includes a recess part 455 obtained by removing the support substrate 432 between the grouped pins.

The group of the pins 452*a* and 452*b* provided at the left side of the recess part 455 is defined as a first pin part 451, and the group of the pins 454*a*, 454*b*, and 454*c* provided at the right side of the recess part 455 is defined as a second pin part 453.

The number of pins 452*a*, 452*b*, 454*a*, 454*b* and 454*c* of the first pin part 451 is different from that of pins of the second pin part 453.

When the terminal region 450*a* includes the five pins 452*a*, 452*b*, 454*a*, 454*b* and 454*c*, the first pin part 451 may include two pins 452*a* and 452*b*, and the second pin part 453 may include three pins 454*a*, 454*b* and 454*c*.

In this manner, the pins 452*a*, 452*b*, 454*a*, 454*b* and 454*c* are grouped to have the different numbers of pins, so the front surface of the communication module 400 is distinguished from the rear surface of the communication module 400.

In addition, the recess part 455 is formed between the first and second pin parts 451 and 453, thereby preventing the pins 452*a*, 452*b*, 454*a*, 454*b*, and 454*c* of the first and second pin parts 451 and 453 from interfering with each other.

The width of the recess part 455 may be equal to or greater than 0.9 mm, and the pins 452*a*, 452*b*, 454*a*, 454*b* and 454*c* may be spaced apart from each other by the interval of 0.8 mm or less, but the embodiment is not limited thereto.

A protrusion (not shown) protruding from the support substrate 432 may be additionally provided in the boundary region between the first and second pin parts 451 and 453.

Meanwhile, the terminal region 450*a* includes locking grooves 456 recessed in the concave shape from both lateral sides.

Figure 8:
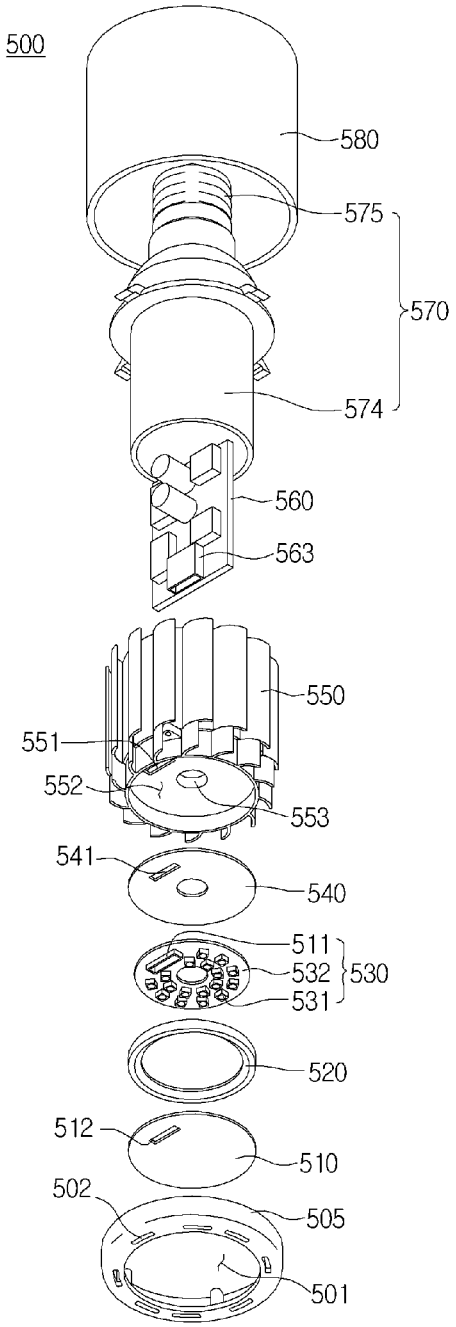
FIG. 8 is an exploded perspective view showing the lighting module of FIG. 2.

Although each locking groove 456 may be formed in a dummy region of the edge region without the pins 452*a*, 452*b*, 454*a*, 454*b*, and 454*c* as shown in FIG. 8, the locking groove 456 may be formed by removing portions of the pins 452*a*, 452*b*, 454*a*, 454*b*, and 454*c* as shown in FIG. 7.

The locking groove 456 is locked to the inner wall surface of the connector 511 when the terminal region 450*a* is inserted into the inserting groove 511 of the lighting module 500, so that the coupling strength can be improved.

The printed circuit board constituting one communication module 400 may have a circuit pattern varied according the type of the wireless integrated circuit 435 and the light control type of the lighting part 530.

Thus, when a plurality of printed circuit boards are formed according to the type of the wireless integrated circuit 435 and the control scheme, the communication module 400 may be constructed by selectively coupling the specific printed circuit board to the housing 411 or 431 of the communication module 400.

Hereinafter the lighting module and the coupling scheme between the lighting module and the communication module will be described with reference to FIGS. 8 to 10.

FIG. 8 is an exploded perspective view showing the lighting module of FIG. 2. FIG. 9 is a sectional view of the lighting module of FIG. 2. FIG. 10 is an enlarged view showing the light source part of the lighting module of FIG. 2.

Figure 9:
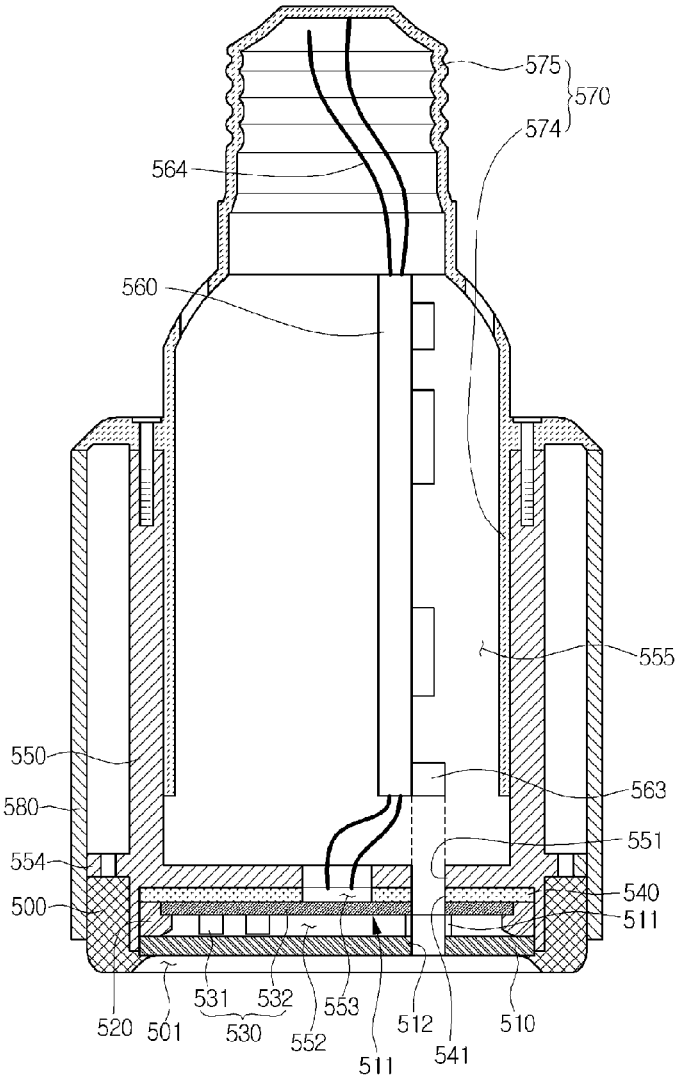
FIG. 9 is a sectional view of the lighting module of FIG. 2.
Figure 10:
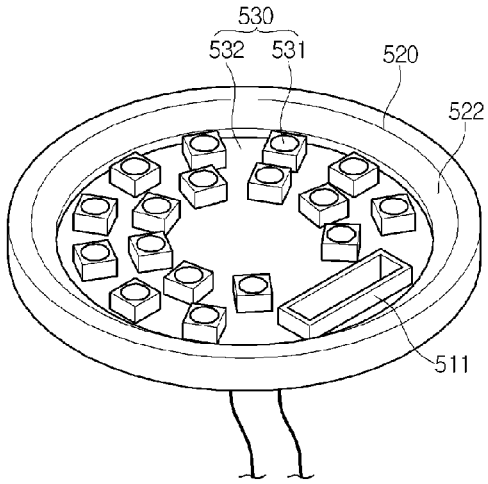
FIG. 10 is an enlarged view showing the light source part of the lighting module of FIG. 2.

Referring to FIGS. 8 to 10, the lighting module 500 according to the first embodiment is a lighting module for a lamp. The lighting module 500 includes an inner case 570 having a connecting terminal 575 at an upper portion thereof and an inserting part 574 at a lower portion thereof, a heat sink 550 having a receiving groove 555 into which the inserting part 574 of the inner case 570 is inserted, a light emitting module part 530 including a plurality of light emitting devices 535 which emit the light to the bottom surface of the heat sink 550, a guide member 505 coupled to a lower peripheral region of the heat sink 550 to allow the light emitting module part 530 to be firmly fixed to the heat sink 550, and an outer case 580 outside the heat sink 550.

The heat sink 550 includes the receiving grooves 555 and 552 which are formed in both surfaces of the heat sink 550 to receive the light emitting module part 530 and the power control part 560, respectively. The heat sink 550 dissipates the heat generated from the light emitting module part 530 and/or the power control part 560.

The upper receiving groove 555, in which the power control part 560 is disposed, may be formed in the upper surface of the heat sink 550. The low receiving groove 552, in which the light emitting module part 530 is disposed, may be formed in the low surface which is opposite to the upper surface.

An opening part 551, through which the communication module 400 passes, is formed in the bottom surface of the low receiving groove 522.

The outer surface of the heat sink 550 may have a concave structure by which the surface area of the heat sink 550 is increased, so that the heat radiation efficiency may be improved.

Further, the heat sink 550 may be formed of a metallic material or a resin material having excellent heat radiation efficiency, but the embodiment is not limited thereto. For example, the heat sink 550 may include at least one of Al, Ni, Cu, Ag and Sn.

The light emitting module part 530 may be disposed in the low receiving groove 552 formed in the bottom surface of the heat sink 550. The light emitting module part 530 may include a substrate 532 and the light emitting devices 531 mounted on the substrate 532.

Each of the light emitting devices 531 may include at least one light emitting diode (LED). The light emitting diode may be a red, green, blue or white LED emitting red, green, blue or white light, but the embodiment is not limited by the type or number of LED.

The light emitting module part 530 may be electrically connected to the power control part 560 by a wire through a through-hole 553 passing through the bottom surface of the heat sink 550 to receive power, so that the light emitting module part 530 may be driven.

A heat radiation plate 540 may be attached to the bottom surface of the light emitting module part 530. The heat radiation plate 540 may be attached to the low receiving groove 552. The heat generated from the light emitting module part 530 may be more effectively transferred to the heat sink 550 through the heat radiation plate 540.

Opening parts 511 and 541 are formed in the light emitting module part 530 and the heat radiation plate 540, respectively.

The opening parts 511 and 541 may be aligned with the opening part 551 of the heat sink 550 and may have the same size as that of the opening part 551 of the heat sink 550.

Since the opening parts 511, 541 and 551 may are aligned with one another, the communication module 400 passes simultaneously through the opening parts 511, 541 and 551.

In this case, as shown in FIG. 10, the opening part 511 of the light emitting module part 530 may protrude downward and the protrusion height of the opening part 511 may be equal to or lower than that of the light emitting device 531.

The light emitting module part 530 may be firmly fixed to the low receiving groove 552 with the guide member 505. The guide member 505 may have an opening part 501 to allow the light emitting devices 535 mounted on the light emitting module part 530 to be exposed to an outside, and may press the periphery surface of the light emitting module part 530 to the low receiving groove 552 of the heat sink 550 to fix the light emitting module part 530.

An air inlet structure, through which air flows between the heat sink 550 and the outer case 580, may be formed in the guide member 505, so that the heat radiation efficiency of the lighting module 500 may be maximized.

For example, the air inlet structure may include a plurality of heat radiation holes 502 formed between the inner and outer surfaces of the guide member 505, or may be a concave structure formed in the inner surface of the guide member 505.

At least one of the lens 510 and a protective ring 520 may be provided between the guide member 505 and the light emitting module part 530.

Various types of lenses, such as a concave lens, a convex lens and a parabolic lens, may be selected as the lens 510, such that the light intensity distribution of the light emitted from the light emitting module part 530 may be desirably controlled. In addition, the lens 510 may include phosphor which is utilized for converting the light wavelength, but the embodiment is not limited thereto.

The lens 510 includes a lens opening part 512 into which the second receiving part 431 of the communication module 400 is inserted.

The lens opening part 512 is aligned with all of the opening parts 511, 541 and 551 formed over the lens opening part 512.

Since the lens opening part 512 is exposed to the bottom surface of the lighting module 500, the interface part 450 and the second receiving part 431 of the communication module 400 are connected to the power control part 560 through the lens opening part 412.

The lens opening part 512 is formed in the periphery region of the lighting module 500, so that the interference with the light emission may be minimized.

While the protective ring 520 prevents moisture or a foreign substance from permeating or being introduced between the guide member 505 and the light emitting module part 530, the protective ring 520 allows the outer surface of the light emitting module part 530 and the inner surface of the heat sink 550 to be spaced apart from each other, so that the light emitting module part 530 and the heat sink 550 are prevented from making direct contact with each other, so the withstand voltage of the lighting module 500 may be improved.

The inner case 570 may include an inserting part 574 inserted into the upper receiving groove 555 of the heat sink 550 at the low region and a connecting terminal 575 electrically connected to an external power source at the upper region.

The side wall of the inserting part 574 is provided between the power control part 560 and the heat sink 550 to prevent the power control part 560 and the heat sink 550 from being short circuited, so that the withstand voltage may be improved.

When the connecting terminal 575 is inserted into the external power source having a socket type, the power may be provided to the lighting module 500. Since the type of the connecting terminal 575 may be variously modified according to the design of the lighting module 500, the embodiment is not limited thereto.

The power control part 560 may be disposed in the upper receiving groove 555 of the heat sink 550.

Although the power control part 560 may include an AC-DC converting device for converting AC power provided from the external power into DC power, a driving chip for receiving the output signal from the communication module and controlling the light emitting module part 530 to be driven, and an ESD (Electro Static Discharge) protecting device for protecting the light emitting module part 530, the embodiment is not limited thereto.

The power control part 560 includes a connector 563 which is formed in the periphery region adjacent to the light emitting module part 530, such that the interface part 450 of the communication module 400 is inserted into the connector 563.

The connector 563 includes a groove opened downward such that the second receiving part 431 and the interface part 450 of the communication module 400 are fixedly inserted into the groove.

The connector 563 is aligned with the opening parts 511, 541 and 551 formed at the low portion, and the pins of the communication module 400 passing through the opening parts 511, 541 and 551 make contact with the pins in the connector 563 so that the output signal is transferred.

The outer case 580, which is coupled to the inner case 570, receives the heat sink 550, the light emitting module part 530 and the power control part 560, and constitutes the appearance of the lighting module 500.

Although the outer case 580 having a circular sectional shape is depicted in the drawings, the outer case 580 may be designed to have a polygonal sectional shape or an elliptical sectional shape, but the embodiment is not limited thereto.

Since the heat sink 550 is not exposed by the outer case 580, a burn injury and an electric shock may be prevented, so that the handing of the lighting module 500 may be improved.

In such a lighting module, the communication module is formed in a dongle type and is fastened to the connector 563 of the power control part 560 from an outside, so that a control signal may be transmitted through a wireless network.

Hereinafter a lighting apparatus according to the second embodiment will be described with reference to FIGS. 11 and 12.

Figure 11:
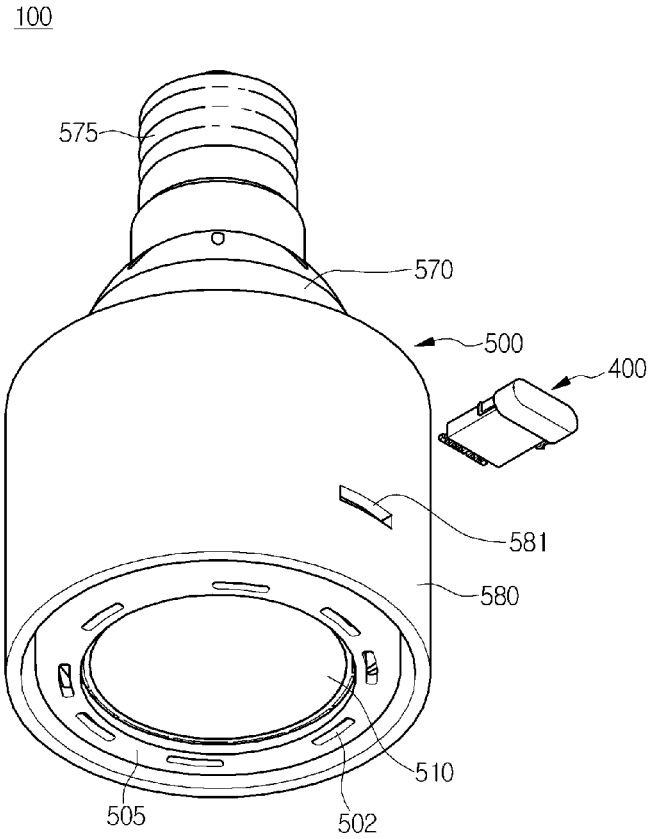
FIG. 11 is a perspective view showing the lighting apparatus of FIG. 1 according to the second embodiment.
Figure 12:
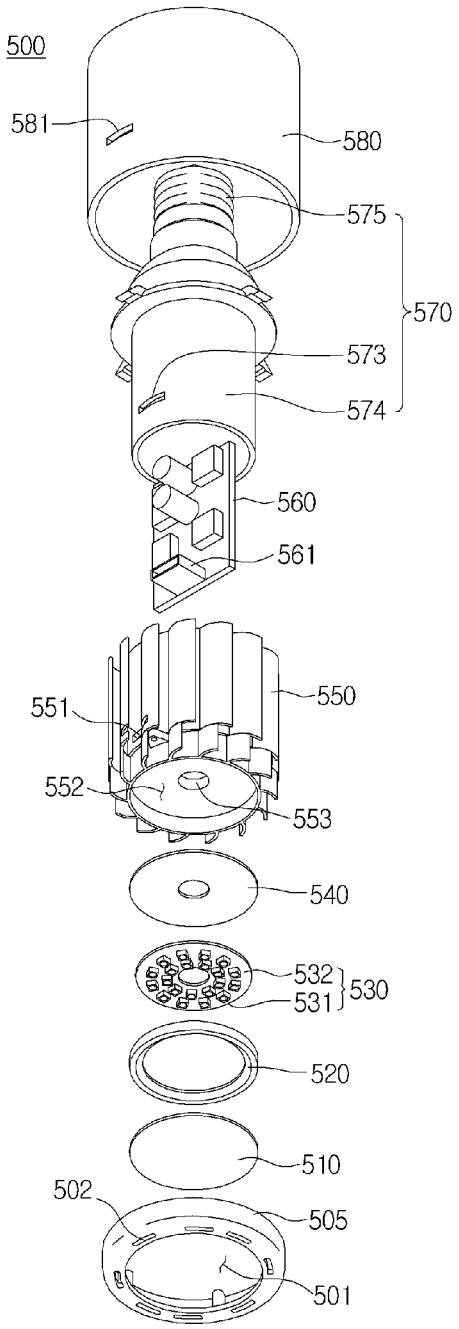
FIG. 12 is an exploded perspective view showing the lighting module of FIG. 11.

FIG. 11 is a perspective view showing the lighting apparatus of FIG. 1 according to the second embodiment. FIG. 12 is an exploded perspective view of the lighting module of FIG. 11.

The lighting module 500 according to the second embodiment includes an inner case 570 having a connecting terminal 575 at an upper portion and an inserting part 574 at a low portion thereof, a heat sink 550 having a receiving groove 555 into which the inserting part 574 of the inner case 570 is inserted, a light emitting module part 530 including a plurality of light emitting devices 535 to emit the light to the bottom surface of the heat sink 550, a guide member 505 coupled to a lower peripheral region of the heat sink 550 to allow the light emitting module part 530 to be firmly fixed to the heat sink 550, and an outer case 580 outside the heat sink 550.

The heat sink 550 includes the receiving grooves 555 and 552 which are formed in both surfaces thereof and receive the light emitting module part 530 and the power control part 560, respectively. The heat sink 550 dissipates the heats generated from the light emitting module part 530 and/or the power control part 560.

The upper receiving groove 555, in which the power control part 560 is disposed, may be formed in the upper surface of the heat sink 550. The low receiving groove 552, in which the light emitting module part 530 is disposed, may be formed in the low surface which is opposite to the upper surface.

An opening part 551, through which the communication module 400 passes, is formed in an outer side surface of the heat sink 550.

The light emitting module part 530 may be disposed in the low receiving groove 552 formed in the bottom surface of the heat sink 550. The light emitting module part 530 may include a substrate 532 and the light emitting devices 531 mounted on the substrate 532.

Each of the light emitting devices 531 may include at least one LED.

The light emitting module part 530 may be electrically connected to the power control part 560 by a wire through a through-hole 553 passing through the bottom surface of the heat sink 550 to receive power, so that the light emitting module part 530 may be driven.

A heat radiation plate 540 may be attached to the bottom surface of the light emitting module part 530. The heat radiation plate 540 may be attached into the low receiving groove 552. The heat generated from the light emitting module part 530 may be more effectively transferred to the heat sink 550 through the heat radiation plate 540.

The light emitting module part 530 may be firmly fixed to the low receiving groove 552 with the guide member 505.

At least one of the lens 510 and a protective ring 520 may be provided between the guide member 505 and the light emitting module part 530.

While the protective ring 520 prevents moisture or a foreign substance from permeating or being introduced between the guide member 505 and the light emitting module part 530, the protective ring 520 allows the outer surface of the light emitting module part 530 and the inner surface of the heat sink 550 to be spaced apart from each other, so that the light emitting module part 530 and the heat sink 550 are prevented from making direct contact with each other, so the withstand voltage of the lighting module 500 may be improved.

The inner case 570 may include an inserting part 574 inserted into the upper receiving groove 555 of the heat sink 550 at the low region and a connecting terminal 575 electrically connected to an external power source at the upper region.

The side wall of the inserting part 574 is provided between the power control part 560 and the heat sink 550 to prevent the power control part 560 and the heat sink 550 from being short circuited, so that the withstand voltage may be improved.

An opening part 575 is formed in a side wall of the inserting part 574 to be aligned with the opening part 551 of the heat sink 550, so that the opening part passes through the interface part 450 and the second receiving part 431 of the communication module 400.

When the connecting terminal 575 is inserted into the external power source having a socket type, the power may be provided to the lighting module 500. Since the type of the connecting terminal 575 may be variously modified according to the design of the lighting module 500, the embodiment is not limited thereto.

The power control part 560 may be disposed in the upper receiving groove 555 of the heat sink 550.

Although the power control part 560 may include an AC-DC converting device for converting AC power provided from the external power into DC power, a driving chip for receiving the output signal from the communication module and controlling the light emitting module part 530 to be driven, and an ESD (Electro Static Discharge) protecting device for protecting the light emitting module part 530, the embodiment is not limited thereto.

The power control part 560 includes a connector 563 which is formed in the periphery region adjacent to the light emitting module part 530, such that the interface part 450 of the communication module 400 is inserted into the connector 563.

The connector 563 includes a groove opened sideward such that the second receiving part 431 and the interface part 450 of the communication module 400 are fixedly inserted into the groove.

The connector 563 is aligned with the opening parts 551 and 573 formed in the side surface, and the pins of the communication module 400 passing through the opening parts 551 and 573 make contact with the pins in the connector 563 so that the output signal is transferred.

The outer case 580, which is coupled to the inner case 570, receives the heat sink 550, the light emitting module part 530 and the power control part 560, and constitutes the appearance of the lighting module 500.

The outer case 580 includes an outer opening part 581 aligned with the opening parts 551 and 573.

As described above, the communication module 400 passes through the side surfaces of the outer case 580, the inner case 570 and the heat sink 550, such that the communication module 400 is connected to the connector 561 of the power control part 560.

Therefore, differently from the first embodiment, the light emitted from the light emitting module part 530 does not interfere with the communication module 400, and the side surface of the lighting module 500, which is a dummy region, is utilized so that the communication module 400 may be mounted easily.

Hereinafter a lighting apparatus according to the third embodiment will be described with reference to FIGS. 13 and 14.

Figure 13:
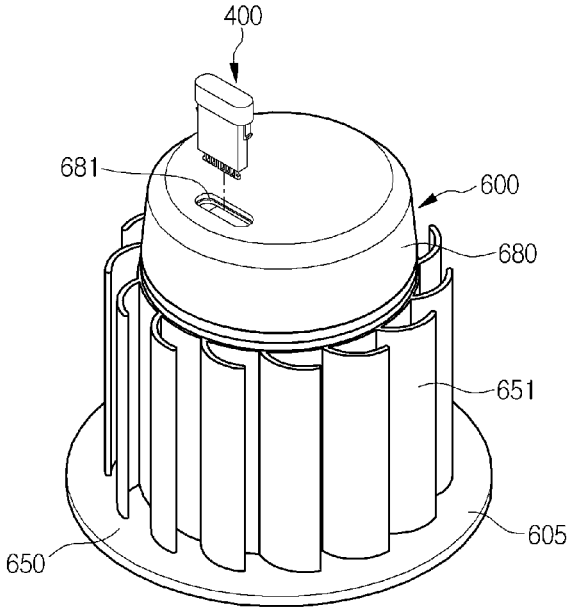
FIG. 13 is a perspective view showing the state of the lighting apparatus of FIG. 1 according to the third embodiment.
Figure 13:
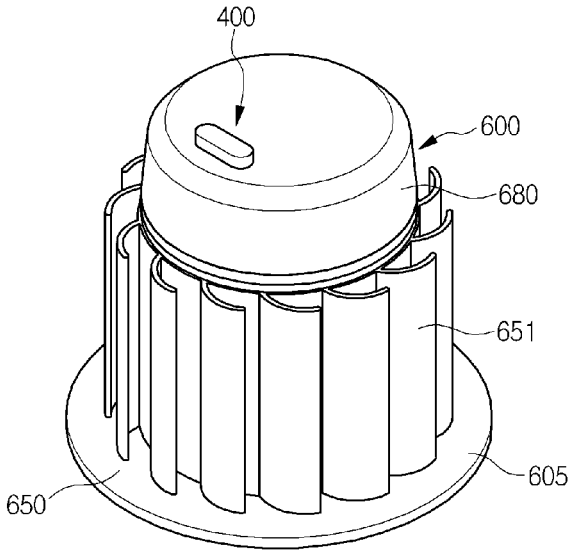
Figure 14:
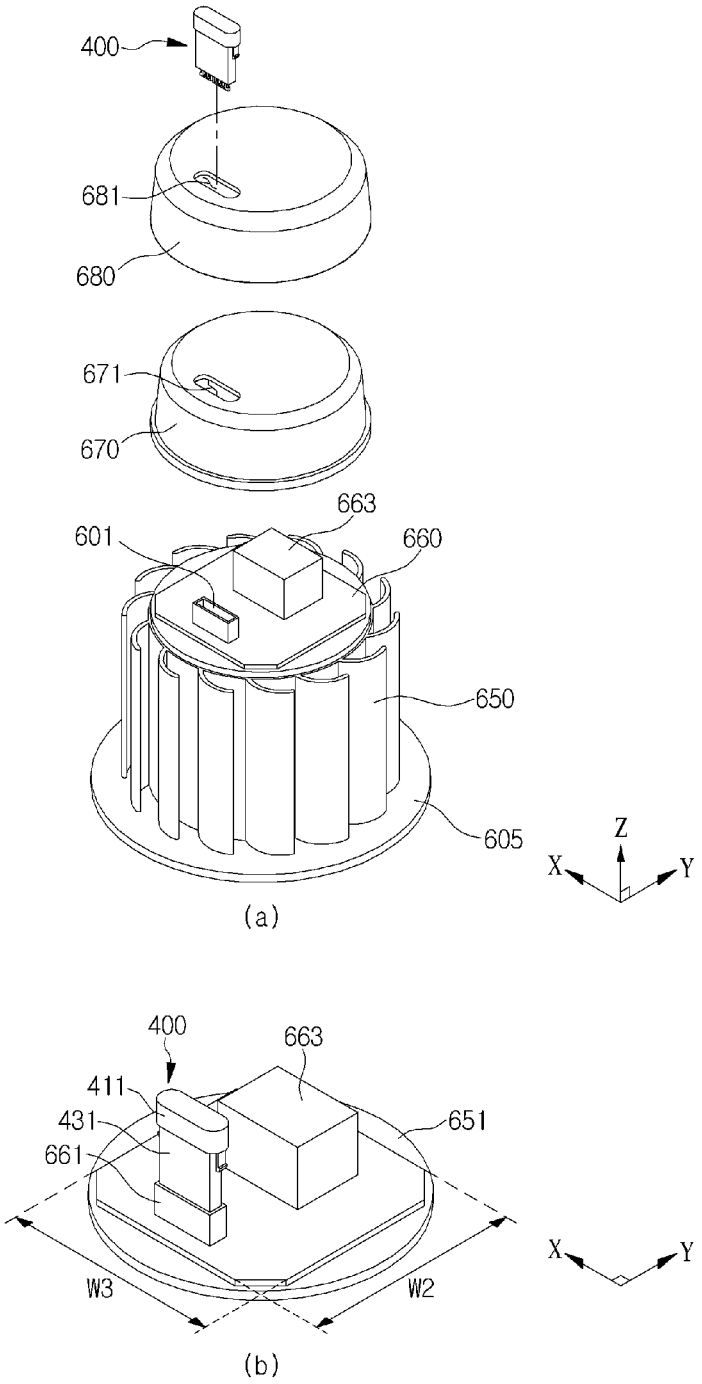
FIG. 14 is an exploded perspective view showing the lighting module of FIG. 13.

FIG. 13 is a view showing a state of the lighting apparatus of FIG. 1 according to the third embodiment. FIG. 14 is an exploded perspective view of the lighting module of FIG. 13.

The lighting module 600 according to the third embodiment is applied to a down-light type embedded lighting apparatus. The light emitting module 600 includes an inner case 670 having an inserting part at a low portion thereof, an outer case 680 including a receiving groove into which the inner case 670 is inserted, a heat sink 650 coupled to the inner case 670 and formed at a lower portion thereof with a receiving groove for receiving the light emitting module part, the light emitting module part including a plurality of light emitting devices to emit light to the receiving groove of the heat sink 650, and a guide member 505 coupled to a lower peripheral region of the heat sink 650 to allow the light emitting module part to be firmly fixed to the heat sink 650.

The heat sink 650 includes a receiving groove (not shown) to receive the light emitting module part from a low portion thereof.

The power control part 650 is attached to the rear surface of the receiving groove of the heat sink 650.

The heat sink 650 dissipates the heats generated from the light emitting module part and/or the power control part 660.

The outer surface of the heat sink 650 may have a concave structure by which the surface area of the heat sink 650 is increased, so that the heat radiation efficiency may be improved.

The light emitting module part may be disposed in the low receiving groove formed in the bottom surface of the heat sink 650. The light emitting module part 630 may include a substrate and the light emitting devices mounted on the substrate.

Each of the light emitting devices may include at least one light emitting diode (LED).

Since the configuration of the light emitting module part is the same as those of the first and second embodiments, the configuration is not depicted.

The light emitting module part may be electrically connected to the power control part 660 by a wire through an inside of the heat sink 650 to receive power, so that the light emitting module part may be driven.

A heat radiation plate (not shown) may be attached to the bottom surface of the light emitting module part 630, and the configuration of the heat radiation plate is the same as that of the first embodiment.

The light emitting module part 530 may be firmly fixed to the low receiving groove 552 with the guide member 505.

A lens (not shown) may be provided between the guide member 605 and the light emitting module part 630.

The power control part 660 may be disposed on the heat sink 650.

Although the power control part 660 may include an AC-DC converting device for converting AC power provided from the external power into DC power, and a driving chip for receiving the output signal from the communication module and controlling the light emitting module part to be driven.

The AC-DC converting device and the driving chip of the power control part 660 are packaged in one unit and are mounted on the substrate.

The connector 661, into which the interface part 460 of the communication module 400 is inserted, is formed on the substrate.

The connector 661 includes a groove opened upward (in a z-axis direction) such that the interface part 460 of the communication module 400 is inserted into the groove.

The substrate of the power control part 660 may have a first width w3 of 60 mm to 65 mm, preferably, 62 mm in the first direction, and may have a width w2 of 60 mm in the second direction, so that the substrate may have a rectangular shape.

The connector 661 extends in the first direction and may have a width w4 of 18 mm to 25 mm, preferably, 20 mm.

The pins of the communication module 400 make contact with the pins in the connector 661 so that the output signal is transferred.

The inserting part of the inner case 670 receives the power control part 660 and the inner case 670 is coupled to the heat sink 650.

The inner case 670 is aligned with the connector 661, and formed in the top surface thereof with an opening part 671, in which the communication module 400 passes through the opening part 671. In addition, the inner case 670 may include at least one hole (not shown) for transferring external power to the power control part 660.

The outer case 680 may cover the inner case 670 and may provide the external appearance of the lighting module 600 when embedded.

In addition, the outer case 680 includes an outer opening part 681 aligned with the opening part 671.

As described above, the communication module 400 passes through the opening parts 681 and 671 of the outer and inner cases 680 and 670, and is connected to the connector 661 of the power control part 660 formed in the top surface of the heat sink 660.

As shown in FIG. 13, the lighting module 600, to which the communication module 400 is coupled, has a region of the first receiving part 431 of the communication module 400 protruding out of the outer case 680, so that the antenna function may be maintained.

Thus, since the embedded portion of the embedded lighting apparatus 100 is coupled to the communication module 400, so that the control signal may be transmitted through the wireless network while the external appearance of the lighting apparatus 100 is not influenced.

Therefore, differently from the first embodiment, the light emitted from the light emitting module part 630 does not interfere with the communication module 400.

Hereinafter a lighting apparatus according to the fourth embodiment will be described with reference to FIGS. 15 and 16.

Figure 15:
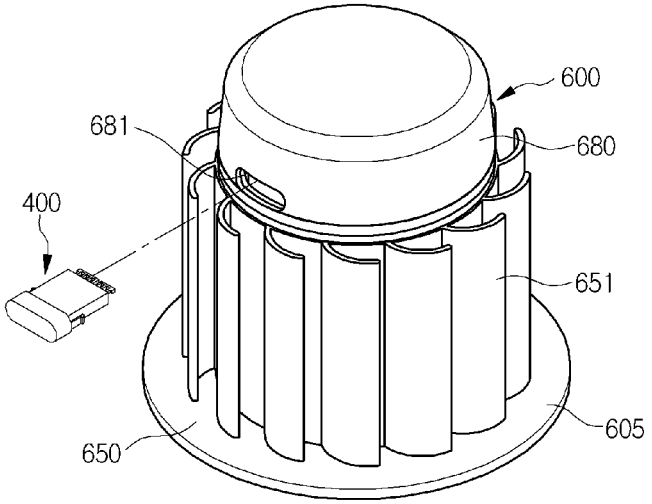
FIG. 15 is a view showing the state of the lighting apparatus of FIG. 1 according to the third embodiment.
Figure 15:
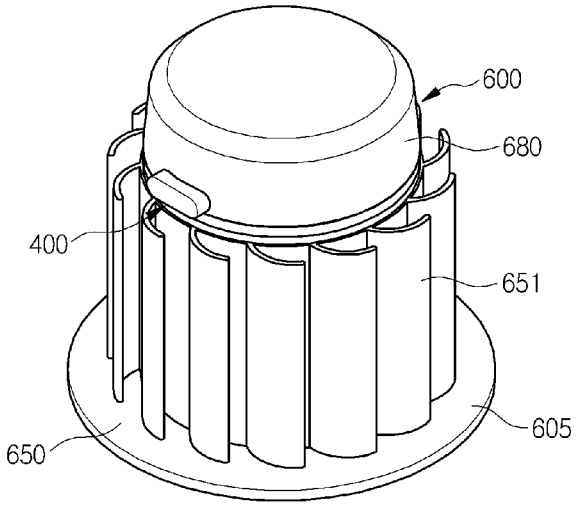
Figure 16:
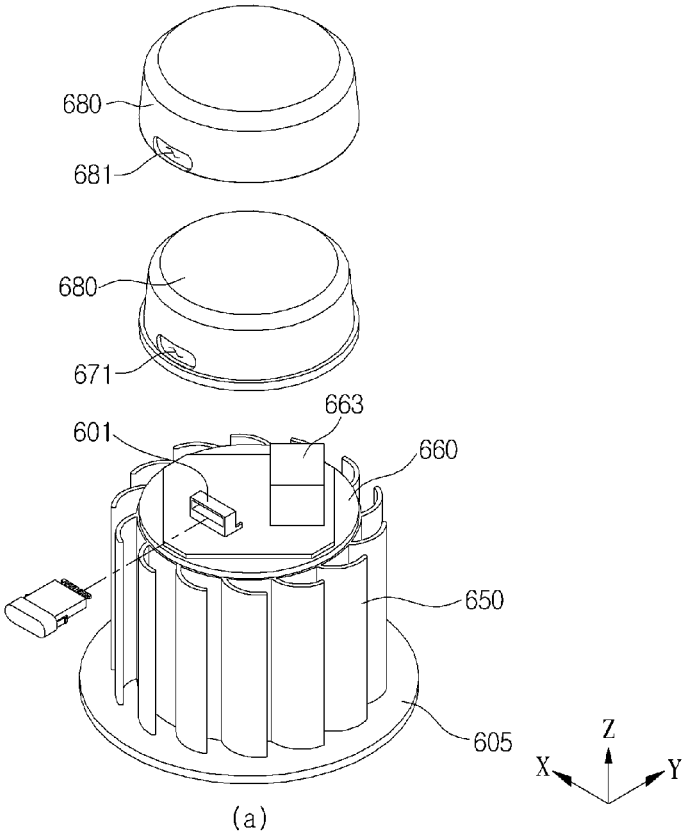
FIG. 16 is an exploded perspective view showing the lighting module of FIG. 15.
Figure 16:
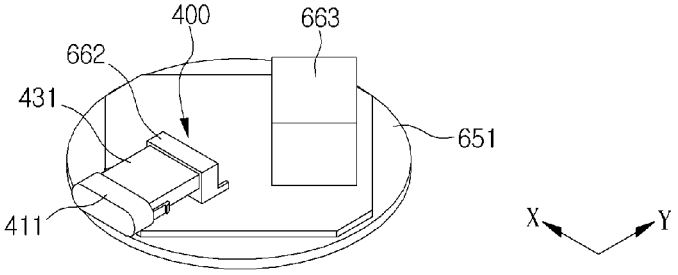

FIG. 15 is a view showing a state of the lighting apparatus of FIG. 1 according to the fourth embodiment. FIG. 16 is an exploded perspective view of the lighting module of FIG. 15.

The lighting module 600, which is a lighting module applied to a down-light type embedded lighting apparatus, has the same basic configuration as that of the third embodiment.

According to the lighting apparatus 100 of the fourth embodiment, the communication module 400 is coupled to the lighting module 600 through the opening part formed in the side surface of the lighting module 600, so that the output signal is transmitted.

To this end, the outer and inner cases 680 and 670 of the lighting module 600 include the opening parts 681 and 671 through which the communication module 400 passes. The opening parts 681 and 671 are aligned with the connector 661 formed in the power control part 660.

The connector 661 includes the groove opened sideward (in a y-axis direction) such that the interface part 460 of the communication module 400 is fixedly inserted into the groove in the side surface of the connector 661.

As described above, the communication module 400 passes through the opening parts 681 and 671 of the outer and inner cases 680 and 670 to connect with the connector 661 of the power control part 660 formed in the top surface of the heat sink 660.

Therefore, the dongle-type communication module 400 is simply fastened to the embedded region of the embedded lighting apparatus 100, so that the control signal may be transmitted through the wireless network without exerting an influence on the external appearance.

Although exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A lighting apparatus comprising:

a lighting module to receive therein a lighting part that emits light to an outside and a power control part having a connector; and a communication module passing through the lighting module and detachably coupled to the connector to transfer a control signal received through a wireless network to the power control part;

wherein the lighting module comprises:

a heat sink receiving therein the lighting part and the power control part, and having a first opening part; and a lens covering the lighting part to protect the lighting part, and having a second opening part;

wherein the lighting part comprises:

a light substrate having a third opening part; and a light emitting device mounted on the light substrate:

wherein the connector is aligned with the first to third opening parts and exposed to an outside through the first to third opening parts; and wherein a housing of the communication module is inserted into the connector from the lens through the first to third opening parts.

2. The lighting apparatus of claim 1, wherein the lighting part and the power control part are mounted on both sides of a bottom surface of the heat sink, respectively.

3. The lighting apparatus of claim 2, wherein a guide member fixes the lighting part to the heat sink.

4. The lighting apparatus of claim 1, wherein the communication module comprises:

the housing provided therein with a space; and a module substrate which is disposed in the space of the housing and on which a wireless communication chip is mounted.

5. The lighting apparatus of claim 4, wherein the module substrate comprises:

an antenna part;

a communication module part to receive the control signal from the antenna part and to generate an output signal through the wireless communication chip; and an interface part having a plurality of pins making contact with the power control part to transmit the output signal.

6. The lighting apparatus of claim 5, wherein the housing comprises:

a first receiving part to receive the antenna part; and a second receiving part to receive the communication module part, and wherein the interface part protrudes out of the housing.

7. The lighting apparatus of claim 6, wherein the first receiving part protrudes to an outside of the lighting module, and wherein the second receiving part is disposed in the lighting module.

8. The lighting apparatus of claim 6, wherein the second receiving part protrudes from a side surface of the first receiving part and is integrated with the first receiving part.

* * * * *